United States Patent [19]

McWatters

[11] 3,956,834

[45] May 18, 1976

[54] DREDGE LADDER SHOCK MOUNTING ARRANGEMENTS

[76] Inventor: William Andrew McWatters, c/o P. E. Terry Charlton Road, East Brookfield, Mass. 01515

[22] Filed: July 25, 1974

[21] Appl. No.: 491,659

Related U.S. Application Data

[60] Continuation-in-part of Ser. No. 471,897, May 21, 1974, which is a division of Ser. No. 195,674, Nov. 4, 1971, Pat. No. 3,821,859.

[52] U.S. Cl. ..... 37/72; 37/67; 403/145

[51] Int. Cl.[2] ..... E02F 3/90

[58] Field of Search ..... 37/72, 67, 64, 65, 66; 403/145, 146, 161, 162; 188/268

[56] References Cited

UNITED STATES PATENTS

| | | | |
|---|---|---|---|
| 2,242,520 | 5/1941 | Grundborg | 37/72 X |
| 3,050,135 | 8/1962 | Kelley | 172/699 X |
| 3,253,357 | 5/1966 | Allard | 37/65 |
| 3,495,409 | 2/1970 | Riedemann | 37/64 UX |
| 3,517,519 | 6/1970 | Kolb et al. | 403/161 X |
| 3,521,387 | 7/1970 | Degelman | 37/72 X |
| 3,579,872 | 5/1971 | Jantzen | 37/72 X |
| 3,739,503 | 6/1973 | Barker et al. | 37/72 X |
| 3,777,376 | 12/1973 | Turner et al. | 37/72 X |
| 3,821,859 | 7/1974 | McWatters | 37/72 X |

FOREIGN PATENTS OR APPLICATIONS

| | | | |
|---|---|---|---|
| 298,911 | 8/1965 | Netherlands | 37/67 |

*Primary Examiner*—Clifford D. Crowder
*Attorney, Agent, or Firm*—Craig & Antonelli

[57] ABSTRACT

Dredge ladder shock mounting arrangements for two or more part dredge ladders with a main dredge ladder part pivotally connected at a dredge platform and a secondary dredge ladder part adjustably connected to the main ladder part. The interconnecting systems for connecting the two ladder parts includes a pivot pin for accommodating changes in the angular inclination of the two ladder parts with respect to one another as well as locking members for pivotally locking the ladder parts in predetermined adjusting working positions. Shock mounting devices are interposed between the pivot pin and the two ladder parts so that relative movement of the ladder parts in a direction radially of the pivot pin axis against the shock absorbing forces is permitted. The locking members includes guide pins relatively fixed in position on the main ladder part which slidably and guidingly engage linearly extending guide slots in the secondary dredge ladder parts, such that the secondary dredge ladder part is constrained for movement only along the longitudinal direction thereof during dredging operations. Preferred embodiments also include additional shock absorbing devices interposed at the pivotal connection between the barge and the main dredge ladder part. These arrangements, by accommodating adjustment of the pivot angle of the ladder parts, will accommodate keeping up to 80% of the cutter blades in the bank at all times.

18 Claims, 7 Drawing Figures

WINCH

III
III

DREDGE LADDER SHOCK MOUNTING ARRANGEMENTS

BACKGROUND AND SUMMARY OF THE INVENTION

The present application is a Continuation-in-Part application of my copending application Ser. No. 471,897, filed May 21, 1974, for DREDGE LADDER AND HOLDING SPUD SHOCK MOUNTING ARRANGEMENTS, which in turn is a Divisional Application of application Ser. no. 195,674, filed Nov. 4, 1971, now U.S. Pat. No. 3,821,859 issued July 2, 1974 subject matter of which application is incorporated herein by reference thereto.

My above-mentioned earlier application was directed to mounting arrangements for rigid dredge ladders at a dredging barge or dredging platform. This earlier application included various shock mounting arrangements for pivot pins interconnecting the dredge ladder and the dredge barge. The present invention is directed to an improved dredging apparatus which may utilize the specific pivot pin mounting arrangements of said earlier application in conjunction with multiple part dredge ladders.

U.S. Pat. No. 3,777,376 discloses a multiple part dredge ladder which includes a main dredge ladder part connected by way of a linking member to a secondary dredge ladder part which carries the cutter head. In order to absorb shock forces experienced by the dredging or cutter head, this U.S. Pat. No. 3,777,376 suggests the utilization of a shock absorber interconnecting the main ladder part and the secondary ladder part in bypassing relationship to the pivot connections at the linkage member connecting said parts. This arrangement of U.S. Pat. No. 3,777,376 is disadvantageous with respect to the complexity of the three part linkage arrangement, the exposure of the separate shock absorber to outside forces where it could be damaged by leakage or collision and the like, and the high cost associated with the complex structure required.

The present invention overcomes the above-mentioned disadvantages of said prior patent by providing the simple interconnection of the main and secondary ladder parts which reliably absorbs shock forces experienced by the cutter head and which is very economical to manufacture and reliable in operation. More particularly, the present invention contemplates dredging apparatus having a main dredge ladder part which is pivotally connectible to a dredge platform, a secondary dredge ladder part having means for accommodating a dredging head, and ladder part interconnecting means for interconnecting the main dredge ladder part and the secondary dredge ladder part together, with the ladder interconnecting means including pivot pin means for pivotally connecting said ladder parts together and shock absorbing means for absorbing shock forces transmitted from said secondary dredge ladder part to said pivot pin means during dredging operations by permitting relative movement of said pivot pin means and at least one of said ladder parts in a direction radially of the pivot axis of said pivot pin means against the restoring force of said shock absorbing means. In this manner a very simple and reliable connection of the two ladder parts is provided, while at the same time obtaining optimum absorption of shock forces experienced in use by the cutter or dredging head. It is contemplated by the present invention to use pivot pin and shock absorber mounting arrangements such as disclosed and claimed in my above-noted parent application. The present invention further contemplates the provision of locking means for locking the ladder parts in a plurality of respective pivoted positions, with the secondary ladder parts being permitted to move in a linear direction to accommodate the absorption of shock forces at the shock absorber means interposed between the pivot pin and the two ladder parts. In particularly preferred embodiments, the locking means includes a guide slot provided at the secondary ladder and a plurality of releasable pins mounted at the main ladder part for selectively engaging the slot to guide and lock the secondary ladder part during dredging operations.

By providing the shock absorbing structure surrounding and/or adjacent engagement with the pivot pin connecting the two ladder parts, the shock absorbing structure is protected by the ladder parts from collision with underwater debris and the like, so as to obviate the need for additional protective housing structure and the like. Also, the ladder interconnecting arrangement of the present invention can be easily adapted to many different multi-part ladder designs, since the basic mode of operation with a simple pivot pin is substantially unimpeded by the shock absorbing arrangement and locking and guiding structure. The simplicity of the interconnection between the ladder parts in accordance with the present invention assures reliability as well as minimal expenditures for manufacture.

In further preferred embodiments of the invention, fluid operated piston-cylinder means are provided for moving the ladder parts to adjusted positions. Preferred embodiments are also contemplated which have fluid operated piston-cylinder arrangements for inserting and withdrawing the releasable pins which lock the ladder parts in adjusted positions with respect to one another.

These and other objects, features and advantages of the present invention will become more apparent from the following description thereof, when taken in connection with the accompanying drawings.

DETAILED DESCRIPTION OF THE DRAWINGS

Figures 1, 2, 3:
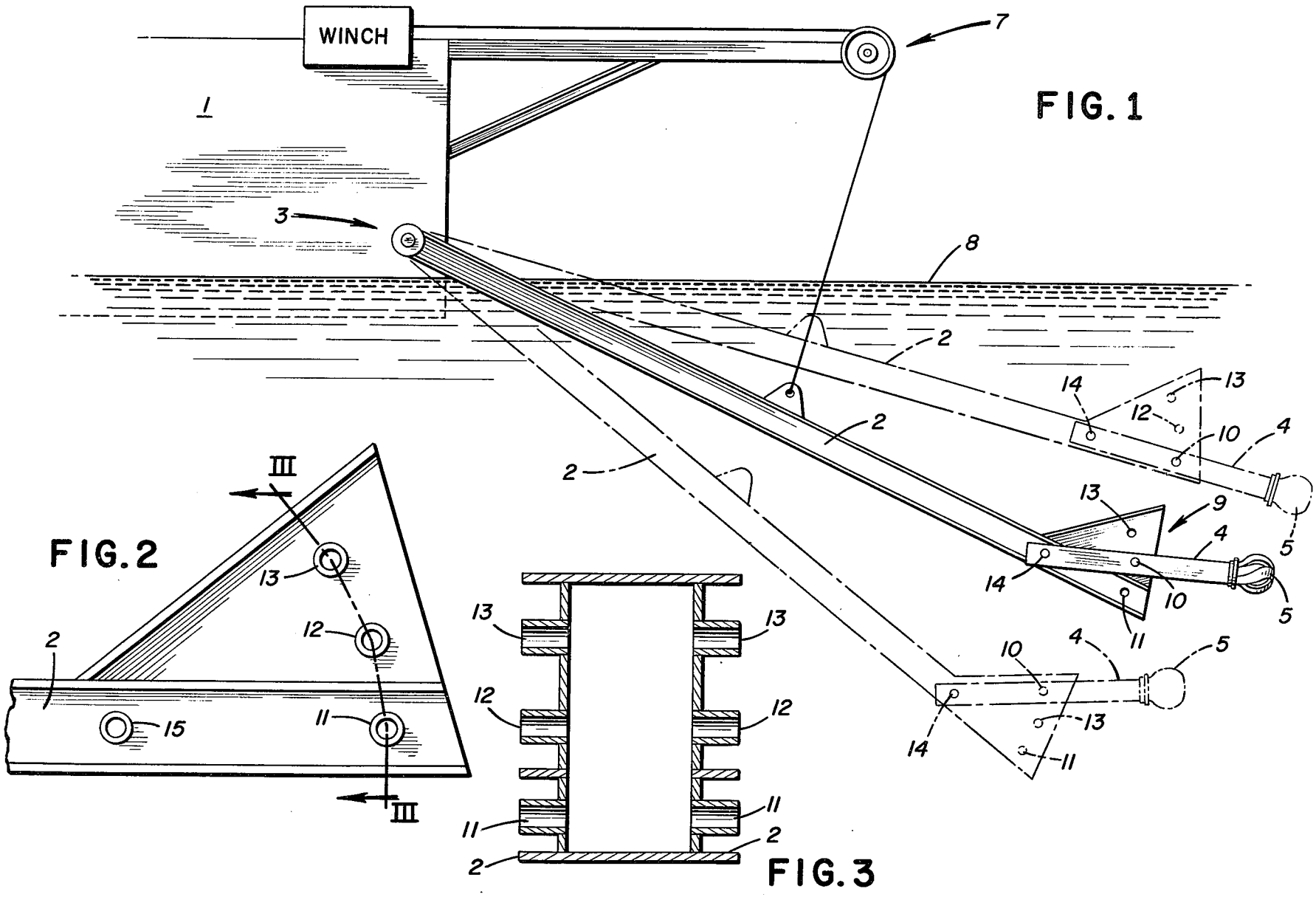
FIG. 1 is a schematic side view depicting three different adjusted positions of a two part dredge ladder constructed in accordance with the present invention.
FIG. 2 is an enlarged partial side view showing the lower end portion of a main dredge ladder part constructed in accordance with the present invention.
FIG. 3 is a sectional view taken in the direction of III—III of FIG. 2.
Figure 4:
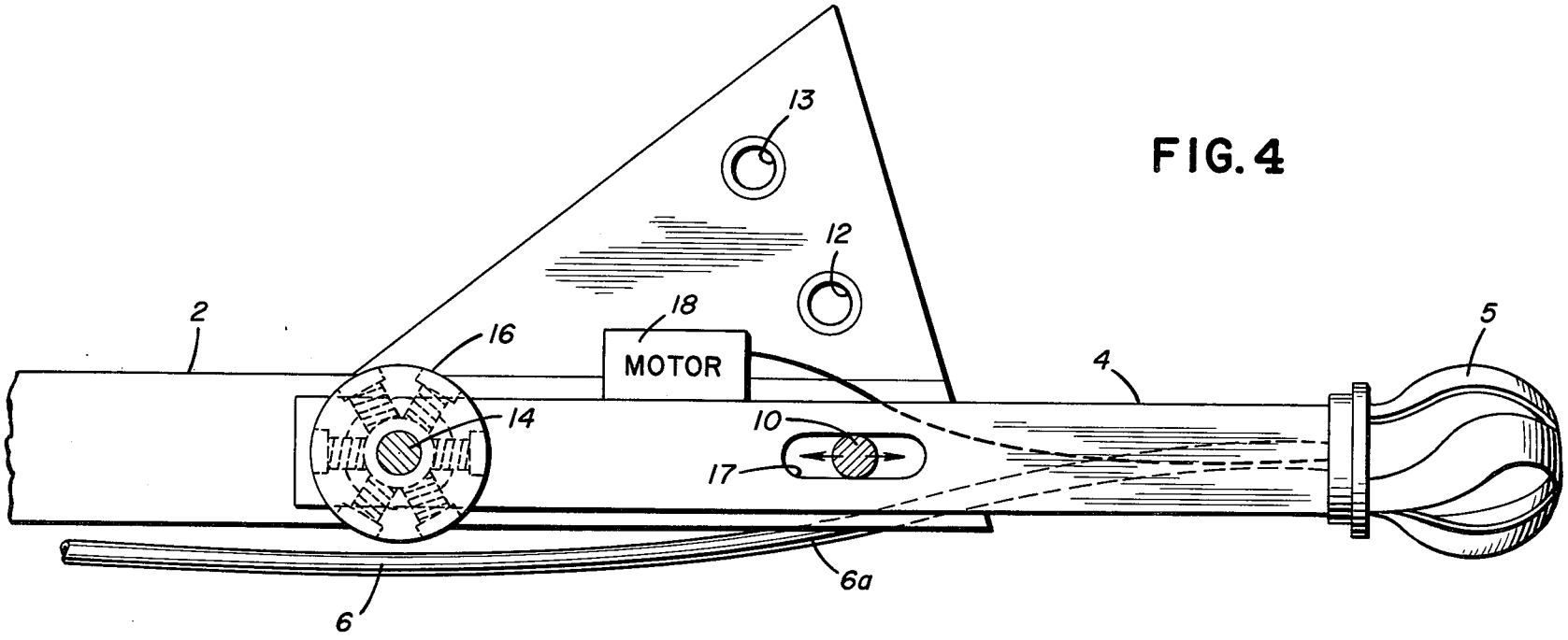
FIG. 4 is a schematic side view depicting the interconnection of the main and secondary dredge ladder parts to one another in accordance with the apparatus of the present invention.

Referring now to the drawings, wherein like reference numerals are used throughout the Figures to designate like structure, and more particularly to FIG. 1, the dredge barge or platform 1 has a rigid main dredge ladder part 2 pivotally connected by pivotal connection 3 adjacent the rear end of the platform 1. This main dredge ladder part 2 is constructed substantially rigid throughout its length by known means. At the lower end of the main ladder part 2, a secondary ladder part 4 is connected. This secondary ladder part 4 has a cutting or dredging head 5 at the outermost end thereof. A suction line 6 (see FIG. 4 as it is not shown in the other Figures so as not to obscure the invention) extends from the cutter head and along the ladder parts 2 and 4 to a remote discharge point. A winching arrangement 7 is provided for lowering the main ladder part 2, and attached secondary ladder part 4 and cutter head 5 into engagement with the surface to be dredged below the water level 8.

The means for interconnecting the main ladder part 2 and the secondary ladder part 4 are depicted generally by reference numeral 9. FIG. 1 schematically depicts the main ladder part 2 and the secondary ladder part 4 in respective different operating positions. In the lowermost position (of part 4 with respect to part 2, upper position of part 2), the secondary ladder part 4 is pivotally fixed with respect to the main ladder part 2 by locking pins 10 extending through lower apertures 11 provided on main ladder part 2. These pins 10 are removable and insertable into the other apertures 12 and 13 to lock the secondary ladder parts 4 in other positions as depicted in the middle and upper (lower position of part 2) showings of FIG. 1. Main support pivot pin 14 extends through reinforced openings 15 provided on the main ladder part 2. FIGS. 2 and 3 include an enlarged view of the construction of the reinforced openings 11 to 13 and 15 at the main ladder part 2.

Figure 5:
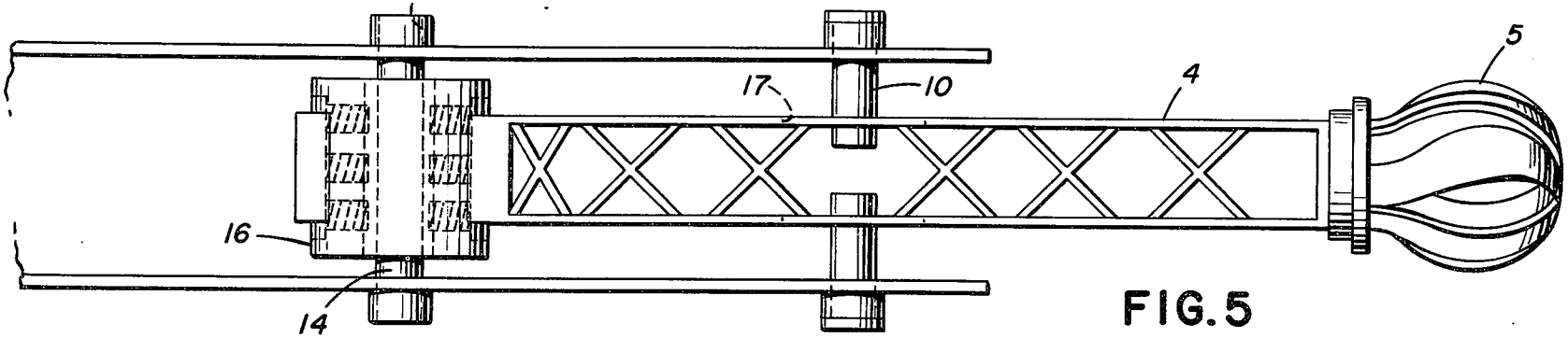
FIG. 5 is a bottom schematic view of the apparatus of FIG. 4.

The main support pivot pin 14 and the secondary ladder part 4 are connected by shock absorbing connections schematically depicted by reference numeral 16. These shock absorbing connections 16 are preferably constructed in a manner as disclosed in my above-noted copending application. However, in the illustrated embodiments of FIGS. 4 and 5, the pivot pin 14 is fixed in position on the main ladder part 2, while the ladder part 4 carries a housing for shock absorbing springs so as to permit relative movement of the ladder part 4 with respect to the pivot pin 14 against the force of the springs of the shock absorber 16. The schematically depicted shock absorber arrangement 16 could be substituted for by single or double housing shock absorbers as described in detail in my above-noted copending application. For example, a simple bearing connection between the ladder part 4 and the pivot pin 14 could be provided, with housings and shock absorber means mounted at opposite sides of this simple bearing connection at the relatively fixed main ladder part 2 so as to permit the radial movement of the pin 14 and connected ladder part 4. The present invention also contemplates embodiments with the pin 14 fixedly positioned on the secondary ladder part 4 and the housing and shock absorbing springs on the ladder part 2.

In order to adequately support the secondary dredge ladder part 4 in position, safety locking pins 10 engage in longitudinal slots 17 provided at the ladder part 4.

These slots 17 engage the pins 10 to prevent relative pivotal movement of the ladder parts 2 and 4, while permitting longitudinal movement along the slots 17, which extend in the same direction as the ladder part 4, so that the ladder part 4 can move against the shock absorbing mechanism 16 to minimize adverse effects due to shock forces experienced at the cutter or dredging head 5.

A motor 18 is mounted on the secondary ladder 4, either of electric or hydraulic type, for driving the cutter head 5. Since this motor 18 is movable with the ladder part 4, appropriate energy or fluid input lines having flexibility to accommodate such movement are to be provided.

The suction line 6 includes a section **6*a* which is resilient so as to accommodate both the pivotal adjustment of the ladder parts 2 and 4, as well as the shock absorbing movements of the ladder part 4 with respect to the ladder part 2**.

Since all of the shock absorbing mechanisms are housed within the inherently rigidly constructed main ladder part 2, the same is well protected in an economical reliable manner. Although the illustrated embodiment shows the shock absorbing mechanism extending beyond the cross-section (above and below) of the main ladder part 2, preferred embodiments are contemplated with the shock absorber mechanisms entirely within such cross-section. Also, since the main ladder part 2 is to be constructed very rigid and strong to carry the cutting forces, the same is particularly well adapted to support the locking pins 10 for guiding and controlling the secondary ladder parts 4.

In another preferred non-illustrated embodiment of the present invention the pivot connection 3 at the barge structure is provided with shock absorbing means and the pivotal connection of the ladder parts 2 and 4 is relatively rigid. That is the pivot pin connection 14 is relatively fixed so that relative linear movement of the parts 2 and 4 is substantially precluded. With this arrangement, the advantages of the shock absorbing mount at the barge structure, as described in detail in my above-mentioned copending application, are obtained, while providing for a simple pivotal connection and ready exchange of cutter heads at the secondary ladder part. The present invention also contemplates providing linear shock absorbing structures at the pivot connection at both the barge platform and at the connection of the two ladder parts. The present invention also contemplates other multi-partite dredge ladder arrangements including more than two parts, with shock absorbing and guiding mechanisms for the various ladder parts similar to those described above with respect to FIGS. 4 and 5 of the preferred two part ladder arrangement.

Figure 6:
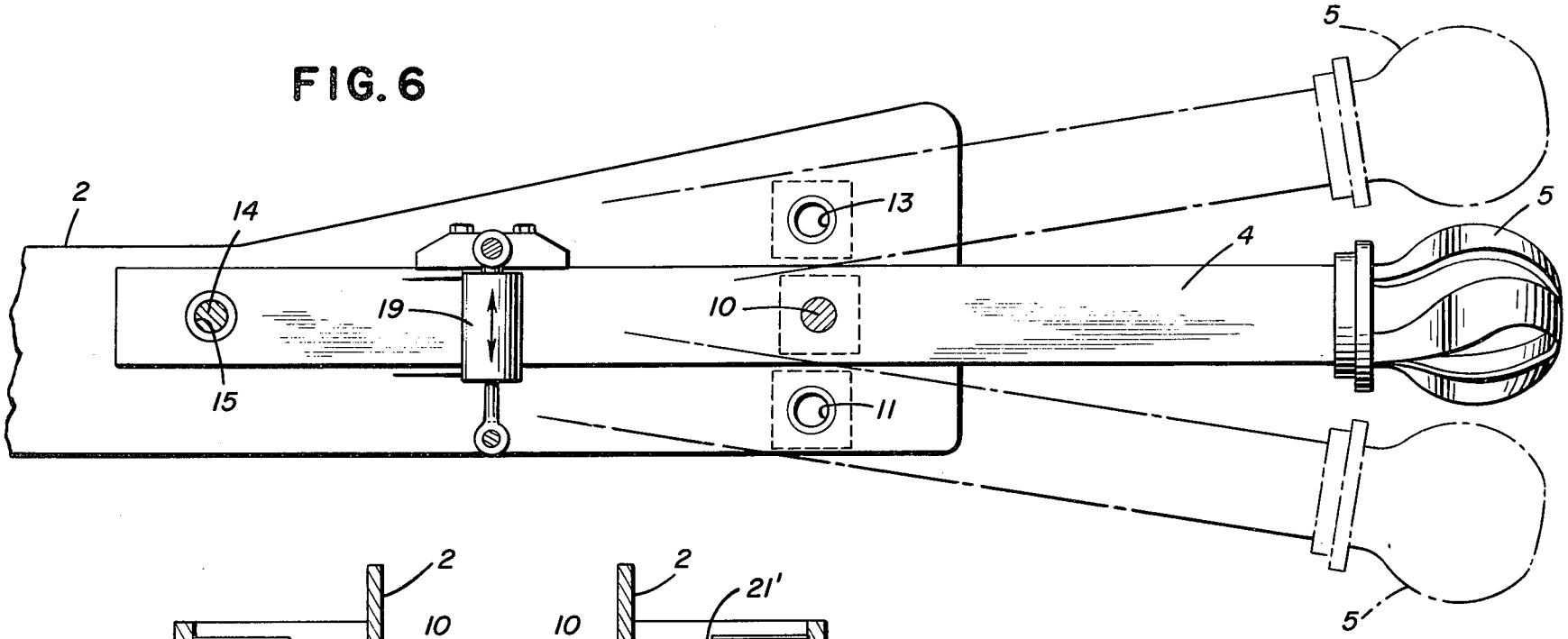
FIG. 6 is an enlarged schematic partial side view showing another preferred embodiment with hydraulic piston-cylinder means for moving the ladder parts between adjusted positions and for inserting and withdrawing locking pins.
Figure 7:
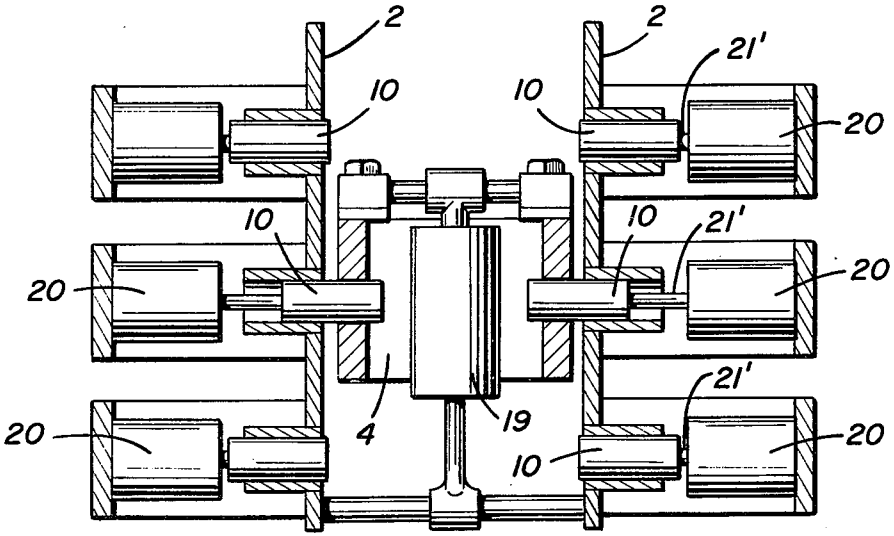
FIG. 7 is a schematic sectional view taken along line VII—VII of FIG. 6.

FIGS. 6 and 7 show another preferred embodiment of the invention which includes a piston-cylinder arrangement 19 for moving ladder part 4 pivotally about 14, between respective adjusted positions. This embodiment also includes piston-cylinder mechanism 20, 21′ for inserting and withdrawing pins 10. With this embodiment, remote adjustment and locking of the ladder parts 2 and 4 can be readily effected. To aid in insertion of pins 10, their ends can be formed conical shaped so that an exact positioning of piston-cylinder arrangement 19 is not required.

An on board sensing system can be used to indicate the relative position of the ladder parts to an operator on the deck of the barge to facilitate actuation of the locking pins. To aid in relieving the load on pins 10, the entire ladder structure can be lowered to engage the head 5 forcibly with the bottom. It is also contemplated by the invention to provide embodiments with the piston-cylinder 19 lifting ladder part 4 from above. Also, a single piston-cylinder arrangement, movable with ladder parts 4 could be used to push all pins 10 into place at one side of the ladder (pins would then be resiliently biased outwardly with the piston plunger abuttable with a part thereof to push the pins into locking position.)

While I have shown and described only several basic embodiments in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are within the scope of those skilled in the art. For example, the shock absorbing means may be coiled spring with sliding block arrangements as in my above-noted application, also hydraulic means, rubber means, or other shock absorbing arrangements at the pivot pin could be substituted for the spring in the connections at the pivot pins. Also, embodiments are contemplated with piston-cylinder arrangements mounted on the ladder part 4 for selectively pushing locking pins into openings provided on the ladder part 2.

I claim:

1. Dredging apparatus comprising:

a main dredge ladder part and means for pivotally connecting one end of said main dredge ladder part to a dredge platform, a secondary dredge ladder part having means for accommodating a dredging head, and ladder part interconnecting means for interconnecting said main dredge ladder part and secondary dredge ladder part together, said ladder interconnecting means including pivot pin means for pivotally connecting said ladder parts together and shock absorbing means for absorbing shock forces transmitted from said secondary dredge ladder part to said pivot pin means during dredging operations by permitting relative movement of said pivot pin means and at least one of said ladder parts in a direction radially of the pivot axis of said pivot pin means against the restoring force of said shock absorbing means, wherein said ladder interconnection means further includes locking means for pivotally locking said ladder parts in predetermined adjusted working positions, and wherein said locking means includes means separate from said shock absorbing means for permitting linear movement of said ladder parts with respect to one another while maintaining a substantially fixed angular orientation of said ladder parts with respect to one another.

2. Apparatus according to claim 1, wherein shock absorber means are also provided at the pivotal connection of said main ladder part and said dredge platform, said last-mentioned shock absorbing means including means for absorbing shock forces transmitted from said main ladder part to a pivot pin at the platform by permitting movement of said pivot pin at the platform against the force of said last-mentioned shock absorbing means.

3. Apparatus according to claim 1, wherein said shock absorbing means are configured completely within the contours of said main ladder part as viewed in the direction of the pivot axis of said pivot pin means.

4. Apparatus according to claim 3, wherein said shock absorber means includes resilient means engageable between said pivot pin means and one of said ladder parts.

5. Apparatus according to claim 4, wherein said resilient means are coil springs housed in a housing carried by said secondary dredge ladder part.

6. Apparatus according to claim 1, further comprising a suction line means extending from along the connection of said ladder parts, said suction line means being resilient and bendable to accommodate changes in the angular orientation of said ladder parts with respect to one another and to accommodate shock absorbing movements of said ladder parts with respect to one another.

7. Apparatus according to claim 1, wherein said interconnection means includes fluid operated piston-cylinder means for forcibly moving said main and second ladder parts between respective adjusted positions.

8. Apparatus according to claim 7, wherein said piston-cylinder means includes a piston fixed to one of said main and secondary ladder parts and a cylinder slidable in said piston and fixed to the other of said main and secondary ladder parts.

9. Dredging apparatus comprising:

a main dredge ladder part and means for pivotally connecting one end of said main dredge ladder part to a dredge platform, a secondary dredge ladder part having means for accommodating a dredging head, and ladder part interconnecting means for interconnecting said main dredge ladder part and secondary dredge ladder part together, said ladder interconnecting means including pivot pin means for pivotally connecting said ladder parts together and shock absorbing means for absorbing shock forces transmitted from said secondary dredge ladder part to said pivot pin means during dredging operations by permitting relative movement of said pivot pin means and at least one of said ladder parts in a direction radially of the pivot axis of said pivot pin means against the restoring force of said shock absorbing means, wherein said ladder interconnecting means further includes locking means for pivotally locking said ladder parts in predetermined adjusted working position, wherein said locking means includes means for permitting linear movement of said ladder parts with respect to one another while maintaining a substantially fixed angular orientation of said ladder parts with respect to one another, and wherein said locking means includes a pin fixed to one of said ladder parts and a guide slot in the other of said ladder parts which is engageable with said pin and constrains said pin to move only linearly therealong.

10. Apparatus according to claim 9, wherein said locking means includes means for accommodating a plurality of angularly spaced pins at said one part such that a plurality of adjusted angular positions of said ladder parts can be obtained with linear guidance of the pins at the guide slot of the other ladder part.

11. Apparatus according to claim 10, wherein said locking means includes a guide slot in said second ladder part and a plurality of spaced pin holes at said main ladder part for accommodating said pins.

12. Apparatus according to claim 11, wherein fluid operated piston-cylinder means are provided for moving said pins into and out of locking engagement between said ladder parts.

13. Apparatus according to claim 12, wherein said piston-cylinder means include a piston and cylinder for each of said pin holes which are respectively aligned with and connected to pins at these holes.

14. Apparatus according to claim 13, wherein said interconnection means includes fluid operated piston-cylinder means for forcibly moving said main and second ladder parts between respective adjusted positions.

15. Apparatus comprising:

a main part and means for pivotally connecting one end of said main part to a relatively fixed member, a secondary part having tool means attached thereto, and interconnecting means for interconnecting said main part and secondary part together, said interconnecting means including pivot pin means for pivotally connecting said parts together and shock absorbing means for absorbing shock forces transmitted from said secondary part to said pivot pin means during operation of said tool means by permitting relative movement of said pivot pin means and at least one of said parts in a direction radially of the pivot axis of said pivot pin means against the restoring force of said shock absorbing means, wherein said interconnection means further includes locking means for pivotally locking said parts in predetermined adjusted working positions, and wherein said locking means includes means separate from said shock absorbing means for permitting linear movement of said parts with respect to one another while maintaining a substantially fixed angular orientation of said parts with respect to one another.

16. Apparatus comprising:

a main part and means for pivotally connecting one end of said main part to a relatively fixed member, a secondary part having tool means attached thereto, and interconnecting means for interconnecting said main part and secondary part together, said interconnecting means including pivot pin means for pivotally connecting said parts together and shock absorbing means for absorbing shock forces transmitted from said secondary part to said pivot pin means during operation of said tool means by permitting relative movement of said pivot pin means and at least one of said parts in a direction radially of the pivot axis of said pivot pin means against the restoring force of said shock absorbing means, wherein said interconnection means further includes locking means for pivotally locking said parts in predetermined adjusted working positions, wherein said locking means includes means for permitting linear movement of said parts with respect to one another while maintaining a substantially fixed angular orientation of said parts with respect to one another, and wherein said locking means includes a pin fixed to one of said parts and a guide slot in the other of said parts which is engageable with said pin and constrains said pin to move only linearly therealong.

17. Apparatus according to claim 16, wherein said locking means includes means for accommodating a plurality of angularly spaced pins at said one part such that a plurality of adjusted angular positions of said parts can be obtained with linear guidance of the pins at the guide slot of the other part.

18. Apparatus according to claim 17, wherein said locking means includes a guide slot in said second part and a plurality of spaced pin holes at said main part for accommodating said pins.

* * * * *